US005906796A

United States Patent [19]

Blevins et al.

[11] Patent Number: 5,906,796

[45] Date of Patent: May 25, 1999

[54] SOLID PHASE EXTRACTION PLATE

[75] Inventors: Dennis D. Blevins; Stephen K. Schultheis, both of Laguna Hills, Calif.

[73] Assignee: Ansys, Inc., Irvine, Calif.

[21] Appl. No.: 08/905,811

[22] Filed: Aug. 4, 1997

[51] Int. Cl.[6] ..... B01L 3/00

[52] U.S. Cl. ..... 422/102; 422/104; 436/180; 436/809

[58] Field of Search ..... 422/102, 104; 436/180, 809

[56] References Cited

U.S. PATENT DOCUMENTS

| | | | |
|---|---|---|---|
| 4,902,481 | 2/1990 | Clark et al. | 422/101 |
| 4,927,604 | 5/1990 | Mathus et al. | 422/101 |
| 5,035,866 | 7/1991 | Wannlund | 422/102 |
| 5,047,215 | 9/1991 | Manns | 422/101 |
| 5,108,704 | 4/1992 | Bowers et al. | 422/70 |
| 5,205,989 | 4/1993 | Aysta | 422/101 |
| 5,264,184 | 11/1993 | Aysta et al. | 422/101 |
| 5,283,039 | 2/1994 | Aysta | 422/104 |
| 5,403,489 | 4/1995 | Hagen et al. | 210/638 |
| 5,417,923 | 5/1995 | Bojanic et al. | 422/101 |

*Primary Examiner*—Krisanne Thornton
*Attorney, Agent, or Firm*—Walter A. Hackler

[57] ABSTRACT

A solid phase extraction plate includes a unitary tray having a plurality of spaced-apart discrete upstanding chambers molded therein with each chamber having a top opening and a bottom nozzle with downwardly tapering sidewalls extending between the top opening and the bottom nozzle. A plurality of solid phase extraction disks are provided and one secured in each of the plurality of chambers without the use of frits or retainer rings utilizing instead tapered sidewalls of the chamber for enabling a press fit of the disks therein.

5 Claims, 2 Drawing Sheets

SOLID PHASE EXTRACTION PLATE

The present invention generally relates to assay assemblies for use in the analysis of liquids by a batch process and is more particularly directed to a solid phase extraction plate for the determination of chemical, bio-chemical or biological nature of various liquids.

Because of the need for the analysis, or assay, of a great number of small quantities of liquids, array trays and assemblies have been developed whereby individual samples of test liquid are prepared and subjected to analysis by multi-test processing utilizing various extraction mediums.

Devices of this type may include a separation medium to which the liquid for analysis are subjected with the medium serving to remove solid/particulate matter from the liquid by filtration or serving as a form of chromatographic medium for selectively separating or indicating a particular characteristic of the fluid being assayed.

A typical prior art solid phase extraction plate assembly is shown in U.S. Pat. No. 5,417,923. The assay trays typically have a plurality of wells, for example, 96, arranged in rows and columns in which the solid phase extraction medium is placed and sequentially treated with liquid reagents and washes involved in the assay of interest.

It should be appreciated that this type of assay tray typically has dimensions in the order of 3 inches by 5 inches, hence, a 96 compartment, or well, assay tray has very small compartment diameters. Allowing for supporting for wall structure, a typical 96 well assay tray having the wells arranged and a typical 8×12 configuration will have well diameters in the order of 0.3 inches.

Accordingly, while the tray with the compartments, or wells, may be formed by injection molding, the insertion of separation medium into each well and the physical requirement of positively supporting the medium within each individual well can be a tedious time-consuming procedure.

Typically, not only is it required to dispose a separate medium in each well, but also a means for fixing or holding the medium in the well in a position suitable for separation, or reaction, with liquids later disposed in the well for assay purposes.

Heretofore, separation mediums, either in particulate form or in slug, or disk, form have been supported in wells structure by means of frits, or retaining rings, see for example, the structure shown in U.S. Pat. Nos. 5,205,989, 5,264,184, 5,283,039 and 5,417,923.

Given the size of the wells, or compartments, in the 96 well assay tray, it can be easily appreciated that the assembly of the small extraction mediums and retainer rings is extremely tedious and, of course, time-consuming and expensive.

The present invention provides for a solid phase extraction plate having simplified construction which does not require the use of frits, or the like, and accordingly, enables significant cost-savings in the assembly thereof.

SUMMARY OF THE INVENTION

A solid phase extraction plate in accordance with the present invention generally includes a unitary tray having a plurality of spaced-apart discrete, upstanding chambers molded therein. Each chamber includes a top opening and a bottom nozzle with downwardly tapering sidewalls extending between the top opening and the bottom nozzle. A plurality of solid phase extraction disks are provided with one of the plurality of disks press fitted between the sidewalls of one of the plurality of changes proximate the bottom nozzle.

Thus, the tapering sidewalls of the chamber provide a fritless means for receiving one of the plurality of solid phase extraction disks. Because no separate retaining rings, or frits, are required to support or maintain the solid phase extraction disks within the chambers, assembly of the solid phase extraction plate is greatly simplified.

More particularly, each of the chamber may have a circular cross section and, in addition, means may be provided for spacing each of the disks from a corresponding nozzle. The structure corresponding to this means for spacing includes a step formed in the sidewall of the chamber proximate the corresponding nozzle. Importantly, this structure also provides means for enabling fluid flow through each of the disks over a diameter of the disk which is greater than the diameter of a nozzle entry port. In this manner, efficient use of each disk is enabled by providing exposed areas on each side of the disk to facilitate fluid flow therethrough. This should be contrasted with prior art devices in which a large portion of the extraction medium is masked by abutment with supporting structure.

While each of the chambers may have differing cross sections or diameter, it is preferable that each of the chambers be identical in order to facilitate assembly of the extraction disks therein.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
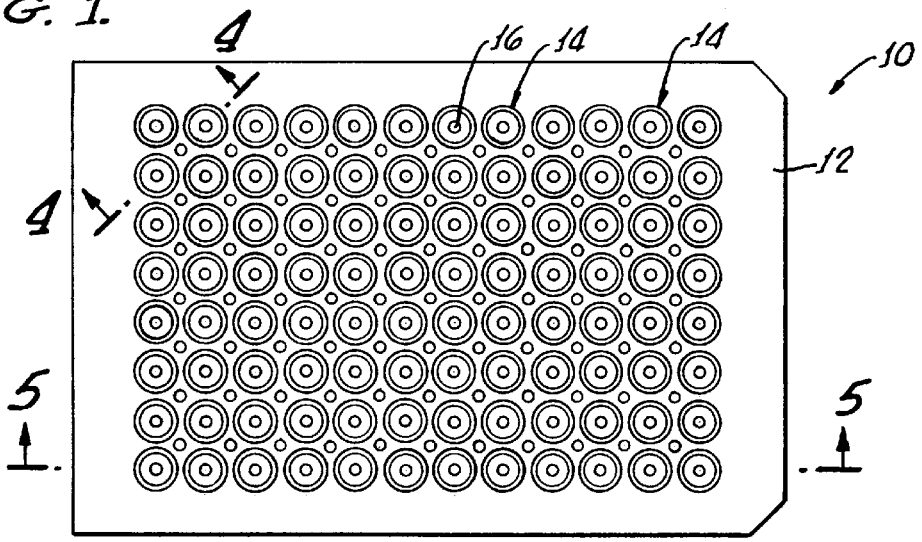
FIG. 1 is a top plan view of a solid phase extraction plate in accordance with the present invention generally showing a unitary tray having a plurality of spaced apart discrete upstanding chambers molded therein.
Figure 2:
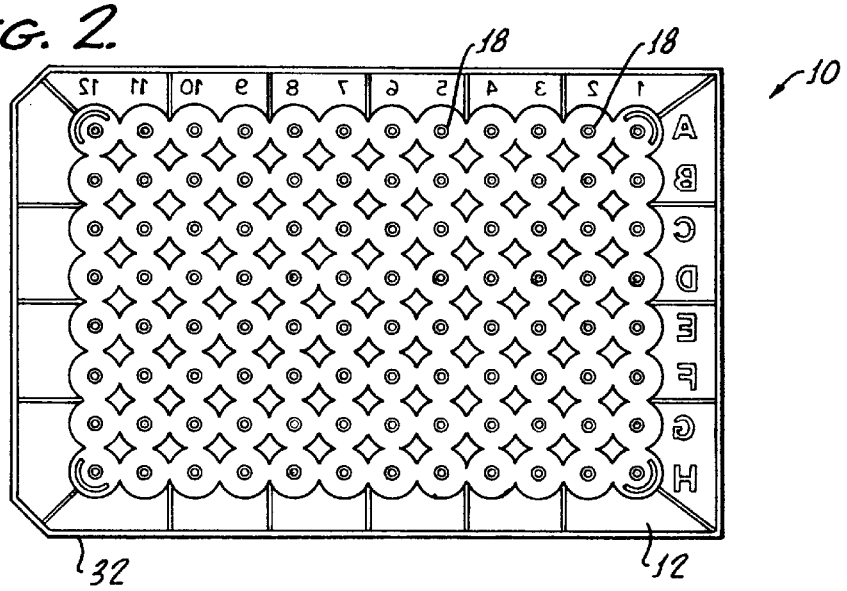
FIG. 2 is a bottom view of the unitary tray shown in FIG. 1.
Figure 3:
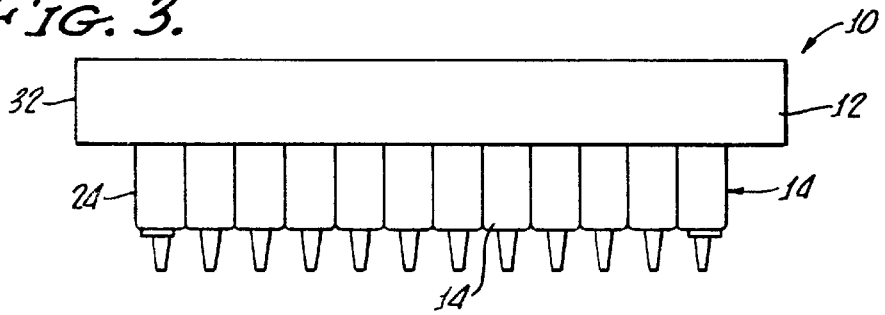
FIG. 3 is a side view of the tray shown in FIGS. 1 and 2.

Turning now to FIGS. 1–3, there is shown a solid phase extraction plate 10 in accordance with the present invention, which generally includes a unitary tray 12 having a plurality of spaced apart discrete upstanding chambers 14 molded therein. The tray 12 may be molded from any suitable material such as, for example, polypropylene.

Figure 4:
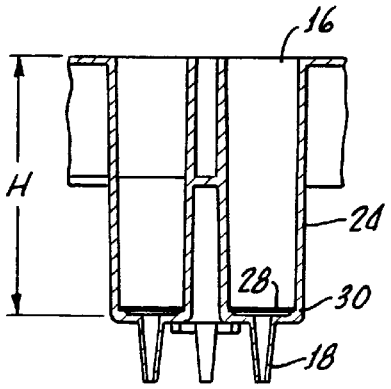
FIG. 4 is a section of the tray taken along the line 4—4 of FIG. 1.
Figure 5:
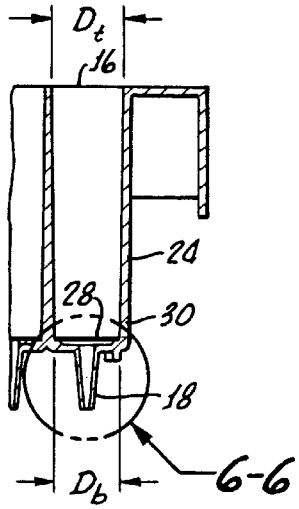
FIG. 5 is a part sectional view taken along the line 5—5 of FIG. 1.
Figure 6:
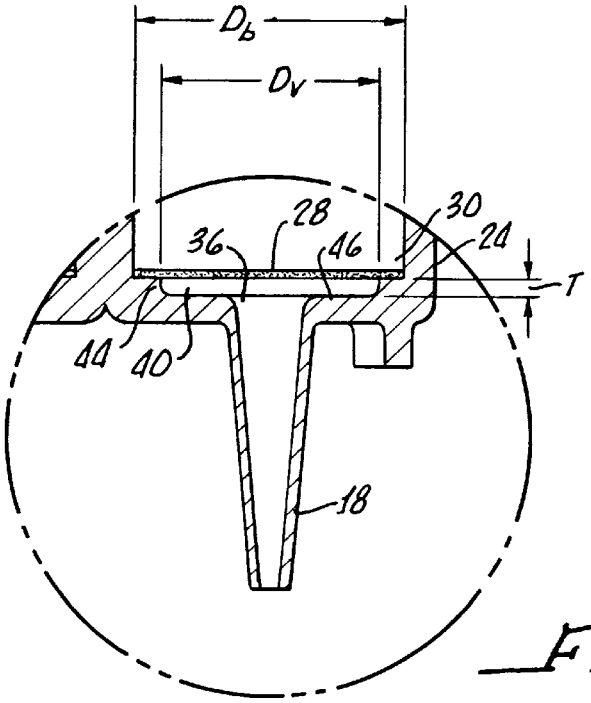
FIG. 6 is a detail of a bottom portion of one of the chambers showing the disposition of an extraction disk therein.

Each chamber 14 has a top opening 16 and a bottom nozzle 18, see also FIGS. 4–6.

Importantly, sidewalls 24 of the chambers 14 taper downwardly from the openings 16 to the nozzle 18.

As most clearly shown in FIG. 6, a plurality of solid phase extraction disks 28 are press fitted between the sidewalls 24 of each of the plurality of chambers 14 proximate the bottom nozzle 18. Any number of different extraction mediums may be utilized and the disk such as, for example, a nonpolar extraction medium containing silica particles bonded with hydrophobic groups, available from Ansys, Inc., Irvine, Calif., under the trade name SPEC® may be utilized.

Because of the tapering nature of the sidewalls 24, the disks 28 are held in position proximate the nozzle 18 by frictional engagement with the side walls 24 and are disposed within the chambers 14 by use of a set of ramrods, not shown. This facilitates placement of the disks 28 in all of the chambers 14 simultaneously. Because no frits or retaining rings (not shown) are utilized, assembly of the solid phase extraction plate 10 is greatly facilitated. The use of polypropylene with wall thickness hereinafter specified provides sufficient resiliency to maintain the disks 28 within the chambers 14 by frictional contact therewith.

As a specific example, the solid phase extraction plate 10 may include the plate 12 having dimensions of about 3 inches wide by 5 inches long, with 96 of the chambers 24 arranged in an array, that is, 8 chambers wide by 12 chambers long.

Importantly, as shown in FIG. 5, the chambers 24 taper with a top inside diameter $D_t$ of about 0.325 plus or minus 0.003 inches to a bottom inside diameter $D_b$ of 0.294 plus or minus 0.001 inches. This enables the disk 28, which has a thickness of about 0.04 inches and a diameter slightly larger than 0.294 inches to be easily inserted through the top opening 16 and forced to a bottom 30 of each chamber proximate the nozzle 18.

Sidewall 24 thicknesses are varied to produce this taper inasmuch as the chambers are unitarily formed in the tray 12 by any suitable molding operation with the sidewalls having a nominal thickness of about 0.032 inches. Overall, the chambers may have a height, H, of about 1.18 inches as indicated in FIG. 4. A surrounding flange 32 is provided for alignment of the chambers 24 with corresponding and accompanying assay apparatus (not shown) for depositing liquid into the openings 16 of the chambers 14.

Turning again to FIG. 6, it can be seen that the nozzle 18 includes an entry port 36 which is smaller than the bottom diameter $D_b$ of the chamber 14.

In order to support the disk 28 proximate that nozzle and create a void 40 therebetween, which may have a thickness T of about 0.04 inches, the disks 28 are supported by steps 44 formed in the sidewall 24 proximate the nozzle 18. The step 44 not only provides a means for spacing each disk 28 of the nozzle 18, but also provides a means for enabling fluid flow through each disk 28 over a diameter greater than the nozzle entry port 36 diameter. Because the disk 28 is not held against the top 46 of the nozzle 18, which is part of the bottom 30 of the chamber 14, flow may pass through the disk 28 over almost its entire surface area. Only where contact with the step 44 is made is straight through flow not enabled. This arrangement significantly improves the efficiency, thus an area having a diameter $D_v$ as shown in FIG. 6 is available for transfer of fluids through the disk, rather than the size of the nozzle entry port 36.

Although there has been hereinabove described specific arrangements of a solid phase extraction plate in accordance with the present invention for the purpose of illustrating the manner in which the present invention can be used to advantage, it should be appreciated that the invention is not limited thereto. Accordingly, any and all modifications, variations or equivalent arrangements, which may occur to those skilled in the art, should be considered to be within the scope and spared of the present invention as defined by the appended claims.

What is claimed is:

1. A solid phase extraction plate comprising:

a unitary tray having a plurality of spaced apart discrete upstanding chambers molded therein, each chamber having a top opening and a bottom nozzle a plurality of solid phase extraction disks, each one of the plurality of disks being sized for press fitting between sidewalls of one of the plurality of chambers proximate the bottom nozzle in order to hold the disks within the chambers by frictional engagement with the sidewalls, each disk comprising a nonpolar extraction medium containing silica particles bonded with hydrophobic groups; and fritless means for enabling each disk to be press fit into a corresponding chamber, said fritless means comprising tapered sidewalls in each chamber.

2. The solid phase extraction plate according to claim 1 wherein each of the chambers has a circular cross section.

3. The solid phase extraction plate according to claim 1 further comprising means for spacing each disk from a corresponding nozzle.

4. The solid phase extraction plate according to claim 2 wherein the means for spacing comprises a step formed in the sidewall proximate the corresponding nozzle.

5. The solid phase extraction plate according to claim 1 wherein each of the plurality of chambers are identical to one another.

* * * * *

UNITED STATES PATENT AND TRADEMARK OFFICE

CERTIFICATE OF CORRECTION

PATENT NO. :5,906,796
DATED :May 25, 1999
INVENTOR(S) :Blevins, et al

It is certified that error appears in the above-identified patent and that said Letters Patent is hereby corrected as shown below:

On the title page, item [75] Inventors: should read -- Dennis D. Blevins; Stephen K. Schultheis, both of Laguna Hills, Calif., David O. Hall, Brea, Calif. --

Signed and Sealed this

Seventeenth Day of August, 1999

*Attest:*

Q. TODD DICKINSON

*Attesting Officer*

*Acting Commissioner of Patents and Trademarks*